US005211491A

United States Patent [19]

Harvey

[11] Patent Number: 5,211,491

[45] Date of Patent: May 18, 1993

[54] THERMAL TRANSFER CARTRIDGE INTEGRAL LOCK

[75] Inventor: Frederick W. Harvey, Webster, N.Y.

[73] Assignee: Eastman Kodak Company, Rochester, N.Y.

[21] Appl. No.: 926,128

[22] Filed: Aug. 5, 1992

Related U.S. Application Data

[63] Continuation of Ser. No. 683,167, Apr. 10, 1991, abandoned.

[51] Int. Cl.[5] ..... B41J 35/28

[52] U.S. Cl. ..... 400/208; 400/194

[58] Field of Search ..... 400/194, 196, 196.1, 400/175, 207, 208, 208.1, 247, 248; 379/445

[56] References Cited

U.S. PATENT DOCUMENTS

| | | | |
|---|---|---|---|
| 3,599,895 | 8/1971 | Janecks | 242/198 |
| 4,032,727 | 6/1977 | Burns, Jr. | 379/445 |
| 4,160,605 | 7/1979 | Neubaum | 400/208 |
| 4,325,645 | 4/1982 | Miyajima et al. | 400/196.1 |
| 4,408,914 | 10/1983 | Ciesiel et al. | 400/208 |
| 4,572,683 | 2/1986 | Hayashi | 400/208 |
| 4,624,592 | 11/1986 | Purcell | 400/208 |
| 4,642,658 | 2/1987 | Arakawa | 400/208 |
| 4,647,726 | 3/1987 | Blum | 379/445 |
| 4,718,785 | 1/1988 | Spath | 400/120 |
| 4,729,676 | 3/1988 | Smith et al. | 400/196.1 |
| 4,750,881 | 6/1988 | Kikuchi et al. | 400/692 |
| 4,867,587 | 9/1989 | Kishida et al. | 400/216.2 |
| 4,875,640 | 10/1990 | Mizutani | 242/198 |
| 4,892,425 | 1/1990 | Shimizu et al. | 400/120 |
| 4,971,463 | 11/1990 | Daley et al. | 400/208 |

FOREIGN PATENT DOCUMENTS

| | | | |
|---|---|---|---|
| 179391 | 10/1984 | Japan | 400/208 |
| 263789 | 11/1986 | Japan | 400/208 |
| 145051 | 6/1988 | Japan | 400/75 |

*Primary Examiner*—Edgar S. Burr
*Assistant Examiner*—Ren Yan
*Attorney, Agent, or Firm*—Raymond L. Owens

[57] ABSTRACT

A transfer cartridge is provided for a thermal printer that has a first printer sidewall defining an opening and a second printer sidewall spaced from the first printer sidewall. The cartridge is positioned between the first and second sidewalls and includes members, engageable with the first sidewall, for releasably locking the cartridge in position between the first and second sidewalls.

1 Claim, 1 Drawing Sheet

THERMAL TRANSFER CARTRIDGE INTEGRAL LOCK

This is a continuation of application Ser. No. 683,167, filed Apr. 10, 1991, now abandoned.

FIELD OF INVENTION

This invention relates generally to thermal printers and, more particularly, relates to a cartridge for a color thermal printer.

BACKGROUND OF THE INVENTION

Thermal transfer cartridges typically used in dye sublimation printers provide internal locks to prevent the spooled media from unwinding when the cartridge is removed from the printer. The internal locks are disengaged when the cartridge is inserted into the printer, and the cartridge must be positioned to offer desired functional features. Holding or locking the cartridge in position in a thermal printer can be accomplished by latches, over-center spring levers, space gates, or by springs attached to doors.

U.S. Pat. No. 4,718,785 which issued Jan. 12, 1988 to M. J. Spath discloses a thermal printer with a cartridge. The printer is a top loading printer wherein a top portion of the printer is pivotally mounted on a base portion and swings up from the base portion to facilitate insertion of the cartridge. When the cartridge is inserted and the top is closed, the top, acting through springs and other mechanisms, exerts a force on the cartridge to keep the cartridge locked in an operating position. Using such an arrangement requires that the top be opened to replace the cartridge. Accordingly, it would be appreciated that it would be highly desirable to have a thermal printer cartridge which can be inserted and removed easily without having to open the top of the printing unit.

U.S. Pat. No. 4,892,425 which issued Jan. 9, 1990 to Shimizu, et al discloses a front or side loading thermal printer and cartridge. In typical fashion, the cartridge has a supply shaft and a take-up shaft with locking mechanisms to prevent rotation of the supply spool and take-up spool under certain conditions. For example, it is desirable to prevent rotation of the supply spool when the cartridge is being inserted or removed from the printer. The cartridge has tabs on it which fit into grooves or passageways in the body of the thermal printer to aid in the alignment of the cartridge. Alignment is important because the supply and take-up spools must be aligned with the drivers that engage the spools. In front or side loading printers of this sort, the cartridge is held in position by the door which may be spring loaded to assure uniform locking pressure on the cartridge. While the door does an adequate job of locking the cartridge into position during use, there is no way to tell whether the cartridge is properly positioned except to operate the cartridge by making a print. Accordingly, it would be appreciated that it would be highly desirable to have a printer cartridge whose operating position could be checked without having to make a test print.

Many thermal printers rely upon the active force of a door to keep the cartridge in position during use. The doors are typically spring loaded or work in conjunction with springs or other mechanisms to either force the cartridge in a certain position or to maintain the cartridge in a certain position. When the door is opened the force is removed and it is not known whether the cartridge is in the proper operating position. Similarly, there is no way to tell whether the cartridge is in the seated operating position even after the door is closed without a test print. In addition to the time and expense required to make test prints, a spring-loaded door is an elaborate device that requires more time and energy to manufacture, thereby utilizing more natural resources than a simple door. It is desirable to have a cartridge which can be properly positioned in an operating position in a thermal printer without the use of elaborate springs or special doors. It is also desirable to have a cartridge which can be checked for proper positioning without the time and expense of making a test print.

SUMMARY OF THE INVENTION

The present invention is directed to overcoming one or more of the problems set forth above. Briefly summarized, according to one aspect of the present invention, an improvement for a thermal printer that has a first printer sidewall defining an opening and a second printer sidewall spaced from the first printer sidewall, comprises a thermal transfer ribbon cartridge. The cartridge is positioned between the first and second sidewalls and includes members, engageable with the first sidewall, for releasably locking the cartridge in position between the first and second sidewalls.

The cartridge is easy to install and locks into position. The cartridge has its own locking mechanism which engages the sidewall of the printer without the use of additional springs, levers, cams, doors, or other devices. The locking mechanism can be operated as a snap lock which, when the cartridge is inserted, snaps in position indicating that the cartridge is locked in position. The locking mechanism is simple to operate and inexpensive to manufacture. The cartridge and locking mechanism are simple to operate because the locking mechanism is integrally formed with the cartridge and can be inserted properly using one hand.

It is an object of the present invention, to provide a thermal printer cartridge which can be easily installed and removed. This objective is achieved by a cartridge which slides into a thermal printer from the front or side of the printer through a simple door or opening. An advantage of this front loading of the cartridge is that installation is simple and the cartridge is visible during insertion making monitoring the insertion process easy.

Another object of the present invention is to provide a thermal printer cartridge that is simple to properly position. It is a feature of the present invention that this objective is achieved by a locking member integrally formed with the cartridge. The cartridge is slideably moved into position and the lock engaged using one hand prior to closing the door. The operation of the cartridge can be monitored through the opening to be sure that the spools operate.

According to another aspect of the invention, a thermal printer cartridge includes a housing having a first sidewall and a second sidewall spaced from the first sidewall. A first member has a first end portion, a second end portion, and a middle portion intermediate the first and second end portions. The first end portion is attached to the second housing sidewall. The middle portion of the first member has a shoulder facing the second end portion of the first member formed at one end of a ramp with the other end of the ramp slanting downward toward the first end portion of the first member. The first member is moveable between a first position at which the ramp is oriented at a first preselected angle with respect to the second sidewall and a second position at which the ramp is oriented at a second angle with respect to the second sidewall. The second angle is greater than the first angle.

It is an object of the present invention to provide a cartridge for a thermal printer that can be easily installed, locked into position and easily removed. This object is achieved by a thermal printer cartridge which has a ramped locking member. As the cartridge is inserted into the printer, the ramped locking member rides along an engaging member of the printer and when the end of the ramp is reached, the ramped member engages the printer member thereby locking the cartridge in position. The ramped member is depressed to disengage it allowing the cartridge to be removed. It is advantageous to have the ramp member because it can provide a snapping function that alerts the user that the cartridge is locked into position.

These and other aspects, objects, features and advantages of the present invention will be more clearly understood and appreciated from a review of the following detailed description of the preferred embodiments and appended claims, and by reference to the accompanying drawings.

DESCRIPTION OF THE PREFERRED EMBODIMENTS

Figure 1:
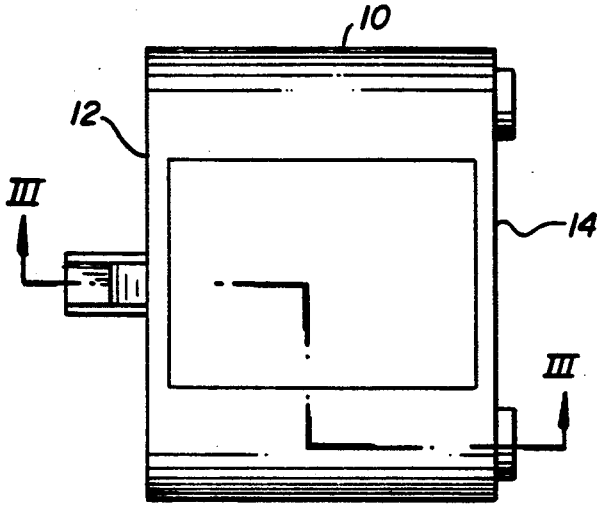
FIG. 1 is a simplified top view of a preferred embodiment of a thermal printer cartridge incorporating a lock in accordance with the present invention.
Figure 2:
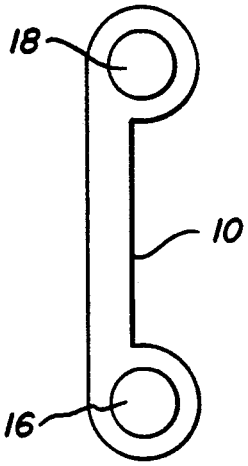
FIG. 2 is a diagrammatic right side view of the cartridge of FIG. 1.
Figure 3:
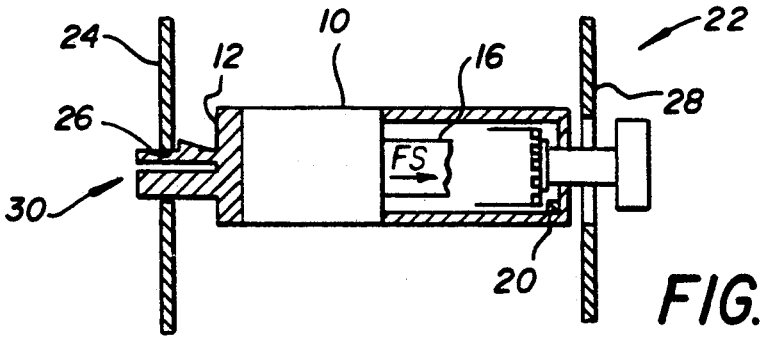
FIG. 3 is a sectional view taken along line III—III of FIG. 1.

Referring now to the drawings, in which like numerals indicate like elements throughout the several figures. FIGS. 1-3 illustrate a thermal printer cartridge 10. The thermal printer cartridge 10 has a housing with a left sidewall 12 and a right sidewall 14. Contained in the housing are a supply spool 16 and a take-up spool 18. Associated with the supply spool 16 is a locking mechanism 20 which functions to control excess movement of the supply spool 16. The lock 20 is known in the art as a lock that prevents the color transfer web wound on the supply spool 16 from unwinding during shipping or storage. This lock 20 disengages when the cartridge is properly inserted into a thermal printer 22 to thereby allow the supply spool 16 to supply donor web for the printing process. When properly installed, the lock 20 will re-engage the donor spool 16 when the thermal printer cartridge 10 is removed from the thermal printer 22.

The thermal printer 22 has a left sidewall 24 defining an opening 26 therein, and a right sidewall 28. The opening 26 is accessible via a door or opening (not shown) on the front or side of the printer 22.

Figure 4:
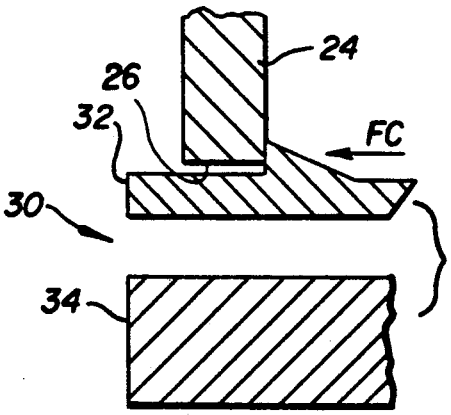
FIG. 4 is a somewhat enlarged diagrammatic view of the locking mechanism illustrated in FIGS. 1 and 3 shown in a locked position.
Figure 5:
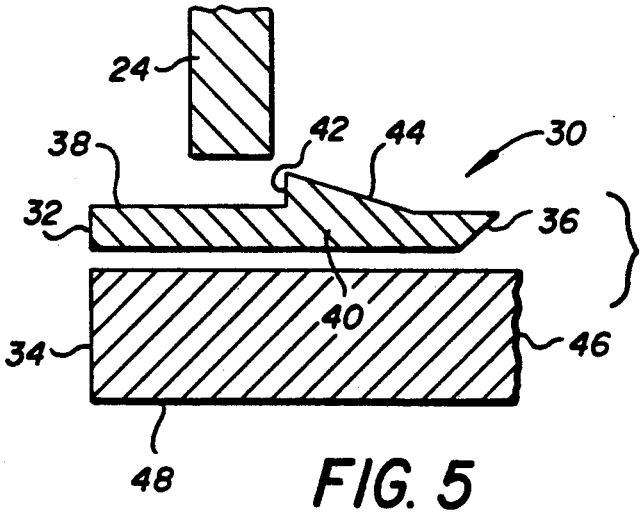
FIG. 5 is a diagrammatic view similar to FIG. 4 but illustrating an unlocked position of the locking mechanism.

Referring now to FIGS. 3-5, the thermal transfer ribbon cartridge 10 is positioned between the left and right sidewalls 24, 28 of the thermal printer 22. The thermal printer cartridge 10 has a locking mechanism 30 for releasably locking the thermal printer cartridge 10 in position between the left and right sidewalls 24, 28 of the thermal printer 22. The locking mechanism 30 includes a first member 32 that is engageable with the left sidewall 24 of the thermal printer 22 through and about the sidewall opening 26 to prevent movement of the thermal printer cartridge 10, toward the left sidewall 24 and away from the right sidewall 28. A second member 34 is also associated with the opening 26 of the left sidewall 24 of the thermal printer 22.

There is relative movement between the first member 32 of the locking mechanism 30 and the second member 34 of the locking mechanism 34. The first member 32 is movable between the locking position (FIG. 4) at which the first member 32 abuts the left sidewall 24, and a released position (FIG. 5) at which the first member 32 is free of abutting contact with the first sidewall 24. At the locking position, the first member 32 is spaced a first, pre-selected distance from the second member 34. At the released position, the first member 32 is spaced a second, preselected distance from the second member 34, with the second distance being smaller than the first distance. By this construction, the locking mechanism can engage the printer sidewall 24 about the sidewall opening 26 to lock the cartridge in position, and can be disengaged by pressing the first and second members 32, 34 towards one another to release the thermal printing cartridge 10.

The first member 32 has a first end portion 36, a second end portion 38, and a middle portion 40 that lies intermediate the first and second end portions 36, 38. The first end portion 36 of the first member 32 is attached to the left housing sidewall 12 which is spaced from the right housing sidewall 14. The middle portion 40 has a shoulder 42 that faces the second end portion 38 of the first member that is formed at one end of a ramp 44 with the other end of the ramp 44 slanting downward toward the first end portion 36 of the first member 32. The shoulder is the vertically oriented portion 42 that extends from the highest point of the inclined ramp back to the middle portion 40 of the first member 32.

The first member 32 is moveable between a first position (FIG. 4) at which the ramp 44 is oriented at a first preselected angle with respect to the left sidewall 12 of the thermal printer cartridge 10 and, a second position (FIG. 5) at which the ramp 44 is oriented at a second angle with respect to the left sidewall 12 with the second angle being greater than the first angle. By this construction, the lesser angle is achieved in a locked position of the cartridge 10 and the greater angle is achieved when the first member 32 is urged toward the second member 34 during insertion or removal of the cartridge 10.

The second member 34 preferably has a first end portion 46 attached to the left housing sidewall 12 and a second end portion 48 extending in the direction of the second end portion 38 of the first member 32. The first and second members 32, 34 are preferably integrally formed with the other portions of the thermal printer cartridge 10. The first member 32 is moveable between a locking position at which the first member 32 is spaced a first pre-selected from the second member 34, and a released position at which the first member 32 is spaced a second pre-selected distance from the second member 34. The second distance is smaller than the first distance. By this construction, the greater distance is achieved in a locked position of the cartridge 10 and the lesser distance is achieved when the first member 32 is urged toward the second member 34 during insertion or removal of the cartridge 10.

Operation of the present invention is believed to be apparent from the foregoing description and drawings, but a few words will be added for emphasis. The thermal printer cartridge 10 can be inserted in a thermal printer using only one hand by opening the door of the printer, which does not have to be spring loaded or otherwise biased because it does not have to exert pressure on the thermal printer cartridge 10 to keep the cartridge in position. With the door open, the locking mechanism 30 is activated by squeezing the first and second locking members 32, 34 and pushing the cartridge into place. When the cartridge is inserted through the opening and is between the sidewalls 24, 28 of the printer 22, the locking mechanism is released. If the thermal printer cartridge 10 is fully inserted, the members 32, 34 will assume the locking position with the shoulder 42 urged against the sidewall 24 of the printer. In this position, the thermal printer cartridge 10 cannot be removed by simply pulling on the locking mechanism 30.

On the other hand, if the ramp 44 of the first member 32 engages or abuts the opening 26 of the sidewall 24 of the printer 22, then the cartridge can be moved laterally by pulling or pushing on the locking mechanism 30. Pushing on the locking mechanism 30 causes the cartridge to shift to the right, as viewed in the drawings, causing the ramp 44 to advance to the right. When the ramp moves to the right far enough, the contact between the ramp 44 and the opening 26 of the sidewall 24 ceases because the sidewall 24 comes to the end of the ramp. When this happens, the first member 32 which had been urged toward the second member 34, originally under the force of the fingers and subsequently under the force of the ramp contact with the opening 26 of the sidewall 24, will be relieved of the force and spring upward toward the sidewall 24 causing the shoulder to abut the sidewall 24. When the shoulder 42 abuts the sidewall 24, the thermal printer cartridge 10 is locked into position. When the first member 32 springs upward there may be a decisive snap indicating locking.

The thermal printer cartridge 10 is removed by reversing the process which is depressing or squeezing the members 32, 34 so that they are urged toward one another to disengage the sidewall 24 from the shoulder 42. Disengaging the shoulder 42 and sidewall 24 allows the thermal printer cartridge 10 to be pulled out when the locking mechanism 30 is pulled outward to the left as viewed in the drawings.

It will now be appreciated that there has been presented a transfer ribbon cartridge with a locking mechanism for a thermal printer. The cartridge is positioned between the sidewalls of the printer. The locking mechanism acts in concert with the printer sidewalls to form a simple and effective mechanical lock. When the ramp 44 engages the sidewall 24, there is a snapping action as the sidewall 24 traverses the end of the ramp 44 and quickly falls into place against the shoulder 42 by a snapping action because the force urging the first and second members 32, 34 towards one another is quickly and abruptly released. This give a positive indication of when the cartridge is properly inserted.

The spool within the cartridge is urged by an internal spring force $F_s$ against an internal cartridge lock. The spool will not rotate when the cartridge is out of the printer during normal handling or shipping. Also, when the spool drive engages the supply spool, the spool is repositioned off the internal cartridge lock. To accomplish this, the internal spring force $F_s$ has to be overcome by an operator inserting the cartridge into the printer.

The present invention provides a thermal printer cartridge that is simple to properly position via a locking member integrally formed with the cartridge. The cartridge is slideably moved into position and the lock engaged using a single hand.

The present invention provides an easily installed cartridge for a thermal printer that locks into position. The ramped locking member is advantageous because it provides a snapping function that alerts the user that the cartridge is locked into position. A combination of forces $F_c$ try to unseat the cartridge. The combination of $F_c$, the locking mechanism and printer sidewalls simply, yet accurately, locate the cartridge within the printer. There are no additional latch or lock members that would add cost or additional part tolerances.

While the invention has been described with particular reference to a preferred embodiment, it will be understood by those skilled in the art that various changes may be made and equivalents may be substituted for elements of the preferred embodiment without departing from invention. In addition, many modifications may be made to adapt a particular situation and material to a teaching of the invention without departing from the essential teachings of the present invention. For example, while it is contemplated that the members of the locking mechanism will be constructed of a synthetic resin, other resilient materials, such as metal, can also be used.

As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. A thermal printer, comprising:

a first printer sidewall having an opening;

a second printer sidewall spaced from said first printer sidewall;

a printer cartridge having a supply spool, a take-up spool and a transfer web wound on the supply spool and attached to the take-up spool, and a main body portion positionable between said first and second printer sidewalls;

means, engageable with said first printer sidewall, for releasably locking said cartridge in a position between said first and second printer sidewalls for controlled movement of the transfer web from the supply spool to the take-up spool to effect thermal printing, said means including;

a first member having a first end portion attached to said main body and extending laterally therefrom, a second end portion extending in a direction, and a middle portion intermediate said first and second end portions, said middle portion having a ramp slanting downward toward said first end portion of said first member and a shoulder formed at one end of said ramp facing said second end portion of said first member, said first member being moveable between a first position at which said ramp is oriented at a first preselected angle with respect to said main body and a second position at which said ramp is oriented at a second angle with respect to said main body, said second angle being greater than said first angle; and a second member having a first end portion attached to said main body and a second end portion extending in the direction of said second end portion of said first member, said first member being moveable between a locking position at which said first member is spaced a first preselected distance from said second member and a released position at which said first member is spaced a second preselected distance from said second member, said second distance being smaller than said first distance, said first member being engageable with said first sidewall at said first sidewall opening to prevent movement of said cartridge from said position toward said first printer sidewall or from said second printer sidewall in response to a combination force acting to unseat said cartridge, said second member protruding through said first printer sidewall opening, said first member being moveable between a locking position at which said first and second members abut said first printer sidewall through said printer sidewall opening and a released position at which said first member is free of abutting contact with said first printer sidewall.

* * * * *